US006516173B1

(12) United States Patent
Sbert

(10) Patent No.: US 6,516,173 B1
(45) Date of Patent: Feb. 4, 2003

(54) ION IMPLANTATION TO TUNE TRIBO-CHARGING PROPERTIES OF MATERIALS OR HYBRID SCAVENGLESS DEVELOPMENT WIRES

(75) Inventor: Robert C. Sbert, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/932,495

(22) Filed: Aug. 17, 2001

(51) Int. Cl.[7] ..... G03G 15/08
(52) U.S. Cl. ..... 399/266
(58) Field of Search ..... 399/266

(56) References Cited

U.S. PATENT DOCUMENTS

| | | | | |
|---|---|---|---|---|
| 4,868,600 A | | 9/1989 | Hays et al. | 355/259 |
| 4,984,019 A | | 1/1991 | Folkins | 355/215 |
| 5,124,749 A | | 6/1992 | Bares | 355/202 |
| 5,172,170 A | | 12/1992 | Hays et al. | 355/259 |
| 5,300,339 A | | 4/1994 | Hays et al. | 428/36.9 |
| 5,422,709 A | | 6/1995 | Minagawa et al. | 355/247 |
| 5,448,342 A | | 9/1995 | Hays et al. | 355/259 |
| 5,734,954 A | | 3/1998 | Eklund et al. | 399/266 |
| 5,778,290 A | | 7/1998 | Badesha et al. | 399/266 |
| 5,787,329 A | | 7/1998 | Laing et al. | 399/266 |
| 5,805,964 A | | 9/1998 | Badesha et al. | 399/266 |
| 5,999,781 A | | 12/1999 | Gervasi et al. | 399/266 |
| 6,038,120 A | * | 3/2000 | May et al. | 361/227 |
| 6,049,686 A | | 4/2000 | Folkins et al. | 399/266 |
| 6,298,209 B1 | * | 10/2001 | Kelly et al. | 399/266 |

FOREIGN PATENT DOCUMENTS

EP 0 539 148 * 4/1993

* cited by examiner

*Primary Examiner*—Quana M. Grainger
(74) *Attorney, Agent, or Firm*—Ben Sklar

(57) ABSTRACT

Development electrode wires for use in a Scavengless or Hybrid Scavengless Development system are treated using Ion Implantation so as to minimize the creation of charge potential between the electrode wires and developer material during frictional contact therebetween. Treatment of the wires using Ion Implantation for minimizing the creation of a charge potential is effected without diminishing the hardness of the wire material. In fact, wire hardness and resistance to wire contamination are enhanced using Ion Implantation in fabricating the wires. A bare wire used for the electrode is first plated with a Gold/Platinum alloy. The ions become implanted in the substrate without altering the surface finish of the wire electrodes yet alter the tribo-charging properties or Electronegativity of the wire. The result of Ion Implantation is to tune or match the Electronegativity of the electrode wire with the Electronegativity of the toner material used in the development system.

12 Claims, 3 Drawing Sheets

ION IMPLANTATION TO TUNE TRIBO-CHARGING PROPERTIES OF MATERIALS OR HYBRID SCAVENGLESS DEVELOPMENT WIRES

BACKGROUND OF THE OF THE INVENTION

The present invention relates to development of latent electrostatic images, and more specifically, to electrode members for use in a developer unit in electrophotographic printing machines. Specifically, the present invention relates to electrode wires fabricated such that the phenomena known as wire history and wire contamination are minimized.

Generally, the process of electrophotographic printing includes charging a photoconductive member to a substantially uniform potential so as to sensitize the photoconductive member thereof. The uniformly charged portion of the photoconductive member is exposed to light corresponding to an original document being reproduced. The source of the light may be light reflected from an original document or light emanating from a laser. This records an electrostatic latent image on the photoconductive member.

After the electrostatic latent image is recorded on the photoconductive member, the latent image is developed depositing developer material onto the latent electrostatic image. Two component and single component developer materials are commonly used for rendering the latent electrostatic images visible.

A typical two-component developer material comprises magnetic carrier granules having toner particles adhering triboelectrically thereto. A single component developer material typically comprises toner particles such as silica and titanium and also contain debris picked up from the environment. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of development apparatus for developing latent images and comprising single component developer is known as a scavengless development system, one that uses a donor roll for transporting charged toner to a development zone. At least one, but preferably a plurality of electrode members is closely spaced to the donor roll in the development zone. An AC voltage is applied to the electrode members thereby forming a toner cloud in the development zone, area between the electrode members and the imaged surface. The electrostatic fields emanating from the latent images attract toner from the toner cloud thereby effecting development of the latent images.

Another type of development apparatus for developing latent images on a charge retentive surface such as a photoconductor comprises a two-component developer and is known as a Hybrid Scavengless Development (HSD) system that employs a magnetic brush developer roller for transporting carrier having toner adhering triboelectrically thereto. A donor roll is used in this configuration also to transport charged toner to the development zone. The donor roll and magnetic roller are electrically biased relative to one another. Toner is attracted to the donor roll from the magnetic roller. The electrically biased electrode members cause detachment of toner particles from the donor roll forming a toner powder cloud in the development zone, and the latent image attracts the toner particles thereto. In this way, the latent image recorded on the photoconductive member is rendered visible.

Various types of development systems have hereinbefore been used as illustrated by the following disclosures, which may be relevant to certain aspects of the present invention. In addition to possibly having some relevance to the question of patentability of the present invention, these references, together with the detailed description to follow, may provide a better understanding and appreciation of the present invention.

U.S. Pat. No. 4,868,600 granted to Hays et al describes an apparatus wherein a donor roll transports toner to a region opposed from a surface on which a latent image is recorded. A plurality of electrode members are positioned in the space between the latent image surface and the donor roll and electrically biased to detach toner from the donor roll to form a toner cloud. Detached toner from the cloud develops the latent image.

U.S. Pat. No. 4,984,019 granted to Folkins discloses a developer unit having a donor roll with electrode members disposed adjacent thereto in a development zone. A magnetic roller transports developer material to the donor roll. Toner particles are attracted from the magnetic roller to the donor roller. When the developer unit is inactivated, the electrode members are vibrated to remove contaminants therefrom.

U.S. Pat. No. 5,124,749 granted to Bares discloses an apparatus in which a donor roll advances toner to an electrostatic latent image recorded on a photoconductive member wherein a plurality of electrode wires are positioned in the space between the donor roll and the photoconductive member. The wires are electrically biased to detach the toner from the donor roll so as to form a toner cloud in the space between the electrode wires and the photoconductive member. The powder cloud develops the latent image. A damping material is coated on a portion of the electrode wires at the position of attachment to the electrode supporting members for the purpose of damping vibration of the electrode wires.

U.S. Pat. Nos. 5,300,339 and 5,448,342 both granted to Hays et al., the subject matter of each which is hereby incorporated by reference in their entirety, disclose a coated toner transport roll containing a core with a coating thereover.

U.S. Pat. No. 5,172,170 granted to Hays et al discloses an apparatus in which a donor roll advances toner to an electrostatic latent image recorded on a photoconductive member. The donor roll includes a dielectric layer disposed about the circumferential surface of the roll between adjacent grooves.

U.S. Pat. No. 5,422,709 teaches an apparatus in which a donor roll advances toner to an electrostatic latent image recorded on a photoconductive member. A plurality of electrode wires is positioned in the space between the donor roll and the photoconductive member. The electrode wires extend in a transverse direction relative to the longitudinal axis of the donor roll. The electrode wires are electrically biased to detach the toner from the donor roll so as to form a toner cloud in the space between the electrode wires and photoconductive members. Detached toner from the toner cloud develops the latent image. Electrode wires contact a portion of the surface of the donor roll. As the donor roll rotates, friction between the electrode wires and donor roll causes trapped debris to move away from the toner powder cloud region so as to minimize contamination-produced streaks on the developed image.

U.S. Pat. No. 5,734,954 granted to Eklund et al discloses an apparatus for developing latent electrostatic images wherein a power supply controller, in communication with the power supply, is adapted to adjust an electrode member electrical biasing to avoid air breakdown induced contamination of the electrode member with toner.

U.S. Pat. No. 5,778,290 granted to Badesha et al discloses an apparatus and process for reducing accumulation of toner from the surface of an electrode member in a development unit of an electrostatographic printing apparatus by providing a composite coating on at least a portion of the electrode member.

U.S. Pat. No. 5,787,329 granted to Laing et al discloses an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and an organic coating on at least a portion of nonattached regions of said electrode member.

U.S. Pat. No. 5,805,964 granted to Badesha et al discloses an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a low surface energy inorganic material coating on at least a portion of nonattached regions of said electrode member.

U.S. Pat. No. 5,999,781 granted to Gervasi et al on Dec. 7, 1999 discloses an apparatus and process for reducing accumulation of toner from the surface of an electrode member in a development unit of an electrostatographic printing apparatus by providing an composition coating including a polyimide or epoxy resin, an optional lubricant and metal compound selected from the group consisting of chromium (III) oxide, zinc oxide, cobalt oxide, nickel oxide, cupric oxide, cuprous oxide, chromium sulfate and cadmium sulfide on at least a portion of the electrode member.

U.S. Pat. No. 6,049,686 granted to Folkins et al discloses a developer unit for developing a latent image recorded on an image-receiving member with marking particles, to form a developed image. A donor member is spaced from the image receiving member and adapted to transport marking particles to a development zone adjacent the image-receiving member. An electrode is positioned in the development zone between the image receiving member and the donor member. A voltage supply is provided for electrically biasing the electrode during a developing operation with an alternating current bias to detach marking particles from the donor member, forming a cloud of marking particles in the development zone, and developing the latent image with marking particles from the cloud. The voltage supply periodically electrically biases the electrode during a cleaning operation with a direct current bias and with an alternating current bias so that toner is effectively removed from the wire. The bias levels are chosen to reduce field-induced redeposition of right or wrong sign toner.

As noted above, both Scavengless and Hybrid Scavengless Development (HSD) rely on electrically biased wires, disposed intermediate a developer transport such as a donor roll and a charge retentive surface such as a photoreceptor, to energize the toner into a cloud for development of the latent image on a photoreceptor.

When several images of contrasting (i.e. images varying between high and low values) throughput are developed on the charge retentive surface, toner in the low throughput areas remains on the wire from image to image resulting in a long resident time for the toner on the wires in these low throughput areas. This long resident time of toner moving across the wire without development allows discreet areas on top of the wire and toner to interact triboelectrically. The result is creation of a charge differential that allows toner to electrostatically attach to the wire and buildup in the areas of low throughput that results in a change in development resulting in images that contain underdeveloped areas. This change in development is known as wire history.

The problem of wire history has been satisfactorily solved by coating the wires with a polymeric material that precludes the formation of such a charge differential between the toner and the coated wire. However, polymeric coatings employed for solving the wire history problem are comparatively soft with respect to conventional xerographic developer additives such as titanium and silica. This hardness disparity between the wire coating and the developer additives allows the toner additives to become impacted in the polymer coating resulting in improper image development and/or deposition of toner in areas of the photoreceptor not intended for development. Wire impaction from toner additives takes place along the entire length of an electrode wire but occurs first at the inboard and outboard ends of the wire. The buildup of contaminants on the wire precludes proper image development. Since wire contamination takes place first at the inboard and outboard areas of the wires, underdevelopment is initially more severe adjacent these areas than toward the center of the wires. Additionally, over time, the contaminant buildup, which initially occurs on the bottom of the wire, works its way around to the top of the wire. Contaminants on top of the wire decrease the spacing between the photoconductive surface and the wire to a point where toner particles mixed with the contaminants actually contact the photoconductive surface thereby depositing toner particles in unintended areas. The change in development resulting from additive impaction on the wire coating is commonly referred to as wire contamination. Thus improper development occurs when contaminants are on the bottom of the wire and unintended development eventually occurs when the contaminants work their way around to the top of the wire.

BRIEF SUMMARY OF THE INVENTION

This invention resulted from the need to provide wire electrodes for use in Scavengless development systems wherein both of the failure modes of wire history and wire contamination associated with Hybrid Scavengless Development (HSD) technology are minimized. To overcome the failure modes of both wire history and wire contamination, the general requirements are such that the wire must not produce a charge differential with the toner for wire history and must be hard and smooth so as to prevent wire contamination.

Pursuant to the intents and purposes of the present invention, development electrode wire material is treated using Ion Implantation so as to minimize the creation of charge potential between the electrode wires and developer material during frictional contact. Treatment of the wires using Ion Implantation for minimizing the creation of a charge potential is effected without diminishing the hardness of the wire material. In fact, wire hardness and resistance to wire contamination is enhanced using Ion Implantation for coating the wires. Ion Implantation is a low-temperature vacuum technology that uses a linear accelerator to create a beam of charged atoms, or ions. The ion beam is then shaped and directed toward the device surface such as an electrode wire, embedding ions into the material. The ions are accelerated to an electrode wire at energies high enough to bury them below the target's surface and sub-surface. The ions become implanted in the substrate without altering the surface finish of the target yet alter the tribo-charging properties of the coated wire.

The use of Ion Implantation for implanting suitable materials into is a target component such as the electrode wires used for Hybrid Scavengless Development accommodates both requirements of reduced wire history and wire contamination. As noted above, Ion Implantation is a process where atoms of an element are converted to ions and accelerated to high speeds and directed towards the target substrate. By selecting the correct atoms to implant, the tribo-charging properties of the target can be tuned to be neutral with respect to the contacting developer material. Stated differently, the Electronegativity (EN) to be discussed below, of the wire is tuned to the EN of the developer material. By choosing a suitable metallic material for the wire substrate and implanting ions of select elements the wire history performance of the wire can approach that of polymer coated wires of the prior art while maintaining the desired hardness and surface finish to minimize wire contamination.

The concept of employing Ion Implantation to alter the tribo-charging properties of a substrate material departs from the typical use of the process. Normally ion implantation is used to alter the mechanical properties of a substrate such as hardness and wear resistance. A typical use of an ion beam implanter is to alter the near surface properties of semiconductor materials that are done without regard to matching Electronegativity values of interacting materials.

For a general understanding of the features of the present invention, a description thereof will be made with reference to the drawings.

DETAILED DESCRIPTION OF THE DRAWINGS

FIG. 3 shows a comparison of the electronegativity of bare wires, ion implanted and polymer coated wires.

DETAILED DESCRIPTION OF THE PREFERRED EMBODIMENT(S) OF THE INVENTION

Figure 1:
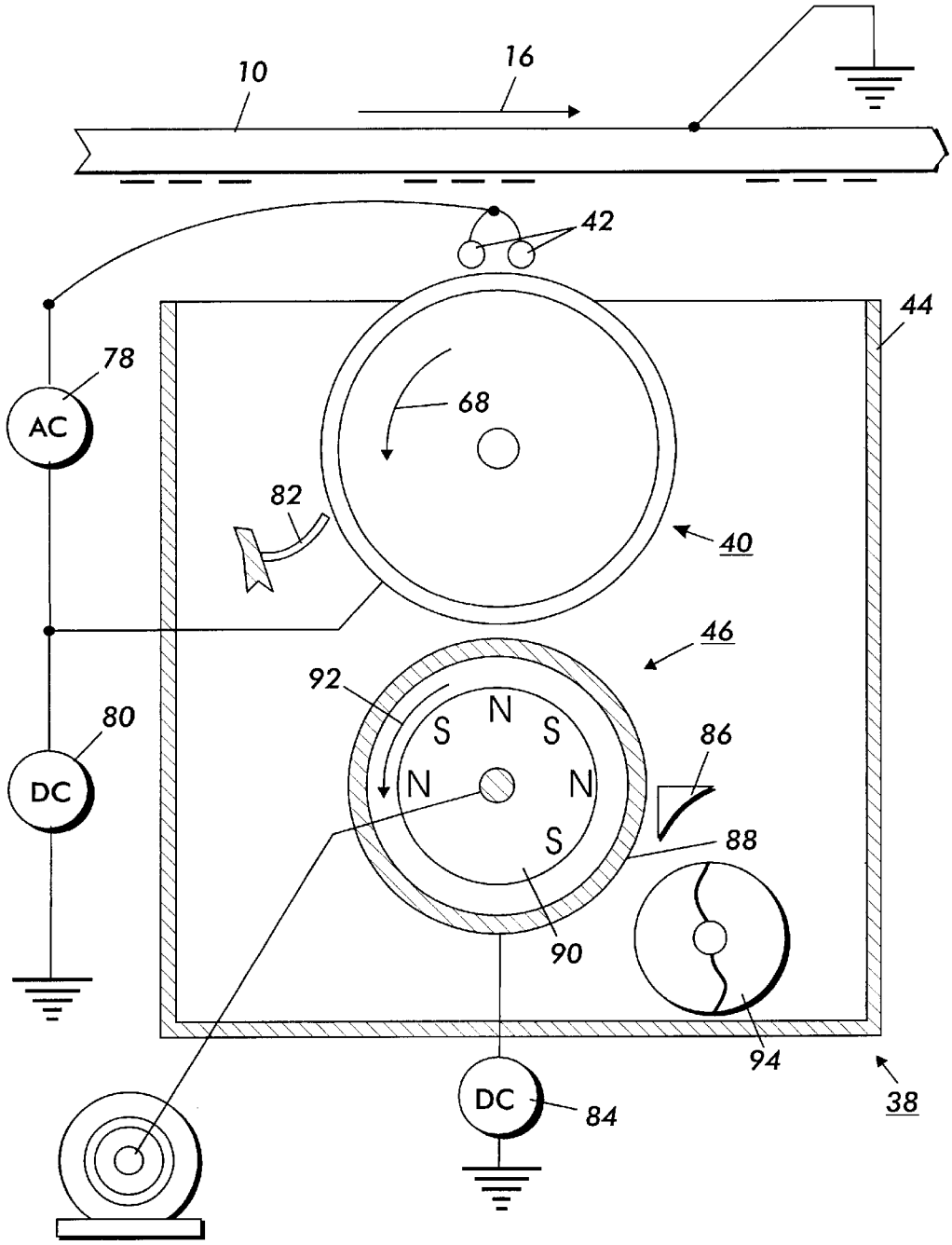
FIG. 1 is a schematic illustration of an embodiment of a development apparatus useful in an electrophotographic printing machine.

Shown in FIG. 1 is a developer unit 38 utilized for developing latent images recorded on the photoconductive surface of a photoconductor belt 10. Preferably, developer unit 38 includes donor roller 40 and electrode member or members 42. Electrode members 42 are electrically biased relative to donor roll 40 to detach toner therefrom so as to form a toner powder cloud in a gap or development zone 43 between the donor roller 40 and photoconductor belt 10. The latent image attracts toner particles from the toner powder cloud forming a toner powder image on the photoconductive surface of the belt 10. Donor roller 40 is mounted, at least partially, within a developer housing 44. The housing 44 contains a supply of developer material. The developer material, for purposes of illustration, is a two-component developer material of at least carrier granules having toner particles adhering triboelectrically thereto. A magnetic roller 46 disposed in the housing 44 below the donor roller 40 conveys the developer material to the donor roller 40. The magnetic roller 46 is electrically biased relative to the donor roller so that the toner particles are attracted to the donor roller 40 from the magnetic roller 46.

Donor roller 40, electrode members 42 and magnetic roller 46 are operatively mounted within housing 44. The donor roller can be rotated in either the 'with' or 'against' direction relative to the direction of motion of belt 10 illustrated by arrow 16. In FIG. 1, donor roller 40 is shown rotating in the counterclockwise direction of arrow 68. Similarly, the magnetic roller can be rotated in either the 'with' or 'against' direction relative to the direction of motion of belt 10. In FIG. 1, magnetic roller 46 is shown rotating in the counterclockwise direction of arrow 92. Donor roller 40 is preferably made from anodized aluminum or ceramic.

Developer unit 38 also comprises a plurality of electrode members 42 which are disposed in a development zone 43 intermediate the belt 10 and donor roller 40. A plurality of electrode members is shown extending in a direction substantially parallel to the longitudinal axis of the donor roller. The electrode members are preferably fabricated from stainless wire having a diameter of approximately 63.5 microns (0.0025 inch) that are closely spaced from donor roller 40 and the photoreceptor belt 10. The spacing between the electrode members 42 and the donor roller 40 is approximately equal to the thickness of a toner layer on the surface of the donor roller 40. The electrode members 42 are self-spaced from the donor roller by the thickness of the toner on the donor roller.

As illustrated in FIG. 1, an alternating electrical bias is applied to the electrode members by an AC voltage source 78. The applied AC establishes an alternating electrostatic field between the electrode members and the donor roller that is effective in causing detachment of toner from the donor roller 40 thereby forming a toner cloud about the electrode members 42, the height of the cloud being such as not to be substantially in contact with the belt 10. The magnitude of the AC voltage is in the order of 650 to 750 volts with a DC offset of about −25 volts provided by a DC bias supply 80. Thus an electrostatic field is established between the photoconductive surface of the belt 10 and donor roller 40 for attracting the detached toner particles from the cloud surrounding the electrode members to the latent images recorded on the photoconductive member. A cleaning blade 82 strips all of the toner from donor roller 40 after development so that magnetic roller 46 meters fresh toner to a clean donor roller. Magnetic roller 46 meters a constant quantity of toner having a substantially constant charge onto donor roller 40. This insures that the donor roller provides a constant amount of toner having a substantially constant charge in the development gap. In lieu of using a cleaning blade, the combination of donor roller spacing, i.e., spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially charge on the donor roller. A DC bias supply 84 which applies a suitable voltage known to those skilled in the art to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain a compressed pile height of the developer material on magnetic roller 46 at a desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 1, an auger, indicated generally by the reference numeral 94, is located in housing 44. Auger 94 is mounted rotatably for mixing and transporting developer material relative to the magnetic roller 46. The auger has blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles that may include toner and carrier particles. The toner dispenser is in communication with the interior of housing 44. As the concentration of toner particles in the developer material is decreased, fresh toner particles are furnished to the developer material in the chamber from the toner dispenser. In an embodiment of the invention, the auger in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, in an embodiment of the invention wherein the toner includes carrier particles, the carrier granules include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 90% to about 99% by weight of carrier and from 10% to about 1% by weight of toner. However, one skilled in the art will recognize that any other suitable developer material may be used.

Pursuant to the intents and purposes of the present invention, bare wires are specially treated using Ion Implantation to modify the tribo-charging or electronegativity characteristics thereof in order to produce the electrode wires 42. Prior to Ion Implantation, individual wires are first coated or plated with a Gold/Platinum alloy wherein the gold comprises 90% of the alloy and the platinum comprises 10% thereof. The alloy forms a top layer on of a wire that is approximately 1 micron thick. Thus, a wire after coating has an overall diameter equal to 65.5 micron. The coated wire is then subjected to the implantation of fluorine ions until the fluorine is present in a concentration of approximately 6 atomic percent at the surface of the wire. The diameter of the wire is unaltered as the result of the implantation of ions. The Electronegativity of wire so modified is thus tuned to be approximately equal to the Electronegativity of the toner being used in a particular developer system. As will be appreciated by those skilled in the art, any one of the parameters such as gold or platinum concentration in the coating alloy as well as the atomic percent of the fluorine implanted may be modified in order to produce a wire having a compatible Electronegativity with other developers which may be used.

The process of Ion Implantation allows for surface and sub-surface modification of a material by injecting ions of elements into the target material resulting in the following benefits:

No change in surface finish

Angstrom level of change in diameter

New material becomes integral to substrate. No adhesion issues

Hardness of substrate increases

To understand how Ion Implantation modifies the tribo-charging or electronegativity characteristics of HSD wires, a description of the wire history and contamination failure modes associated with, for example, bare 304 stainless steel wire and polymer coated wires follows.

Wire History:

This failure mode appears to have two main drivers:

Wire needs to be tribo-electrically neutral with developers

Wire needs a reasonable level of conductivity

Tribo-electrification involves many criteria including chemical composition, material geometry, and type of frictional contact. For simplicity sake, the interface of the wire surface and the developer are regarded as two homogeneous solid surfaces rubbing together. With this assumption, the focus can shift to chemical composition of the materials and their properties. The property of primary interest is Electronegativity. Electronegativity is the measure of how much an atom wants to attract electrons and is typically given values in the Pauling scale.

It's well documented that like materials typically do not produce is a charge differential when rubbed together. A calculated "bulk electronegativity" (EN) can be made of the 304 stainless wire, the toner, and the polymer coating that reduces the wire history effect. The calculation is done by determining the atomic percent of each element in the solid and multiplying its element electronegativity to that and summing the total up.

$$\Sigma(\text{atomic\%} \times \text{elemental Electronegativity})$$

The calculated EN of some typical materials is as follows:

Toners-255

304 Stainless—180

Polymer coating—273

Figure 2:
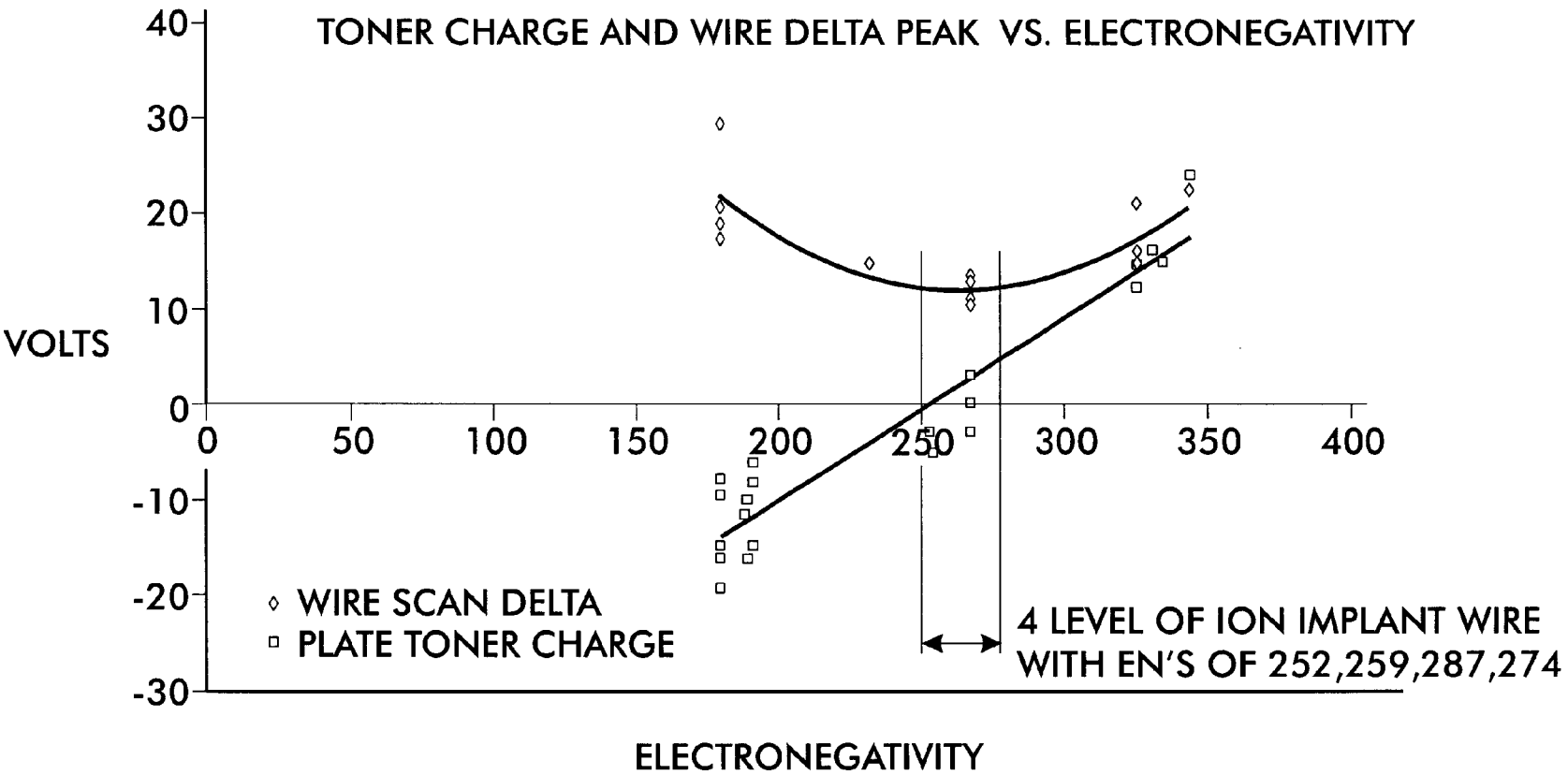
FIG. 2 illustrates toner charge and wire delta peak versus electronegativity.

From these calculated values the inference can be made that since the polymer coating and the toners are close in EN they should have little charging effect between them. Testing performed by rubbing toner between plates of materials having EN from 154 to 344 and plotting the resultant toner voltage versus EN have shown (FIG. 2) that this is a linear function that has a zero point of ≅255. Machine tests of wires made over the same range of EN have resultant peak voltages as measured by an electrostatic voltmeter reveal quadratic function when plotted against EN. The minimum of the machine data curve is at an EN≅258 with a relatively flat transition area giving an effective range of EN≅250–270. FIG. 2 shows both wire scan data from machine test and toner plate charge data from bench tests.

Most metals and their alloys have an EN less than 190 and are not therefore useful as electrode wires in an HSD system. Also, many of the elements with higher electronegativity are not typically found in metals especially in large quantities (fluorine, oxygen, nitrogen, and chlorine). Polymers can be tailored to include these elements. However, the polymer coatings are difficult to adhere to the wire and by their nature are susceptible to the other main failure mode note above as contamination.

As will be appreciated, it is desirable to use materials for electrode wires 42 that approach the EN of toners typically used in this environment. To obtain materials with an EN that approaches that of the toners and the polymer coating, bare 304 stainless wire was processed with Krypton and Oxygen ions. This treatment by calculation resulted in a surface ENs of 213 and 232 respectively. Testing indicates that the tribo-charging properties have been altered by examining the resulting images and by direct wire scan. The machine wire scans data show a reduction of wire history manifestation.

Figure 3:
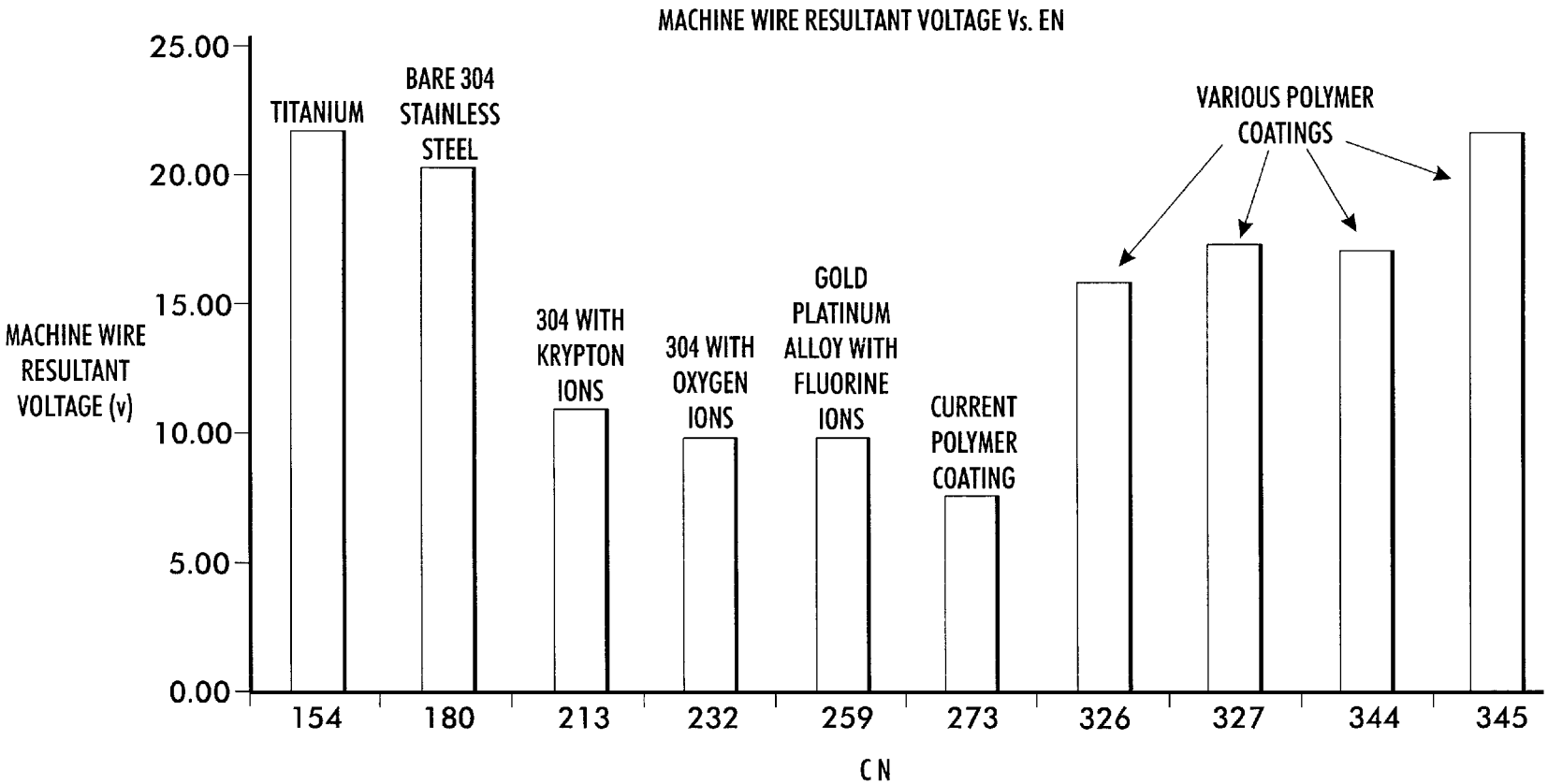
FIG. 3 is a bar chart illustrating machine wire resultant voltage versus Electronegativity for wires that were implanted with selected ions of various materials.

From a consideration of FIG. 3, it can be seen that the wire voltage of untreated titanium and 304 stainless steel wire is over twenty. FIG. 3 also shows that, when 304 stainless steel wires are subjected to Ion Implantation using krypton, oxygen or a wire coated with a gold/platinum alloy implanted with fluorine ions, the voltage is reduced to approximately 50%. FIG. 3 also shows that the voltage of these ion implanted wires approaches the levels of the polymer coated wires currently used on for minimizing wire history. However, unlike polymer coated wires, ion implanted wires, in particular, the Gold/Platinum alloy implanted with fluorine ions which are resistant to wired history also are quite resistant to wire contamination.

Further in accordance with the present invention, a nickel based alloy, Inconel 718 was modified using Ion Implantation to produce electrode wires comprising approximately 38% Flourine at the surface to achieve Electronegativity values which are compatible with the Electronegativity values of the toners with which their use is contemplated. The particular Inconel 718 alloy utilized comprised 52% Nickel, 18.5% Iron, 18.5% Chromium, 5% Columbium (aka Niobium), 3% Molybdenum and 1% Titanium. The last 2% of the alloy comprises Carbon, Cobalt, Aluminum, for example. The concentrations are average for this alloy.

Typical Electronegativity values for toners contemplated for use in the present invention are: Magenta=254, Yellow=260, Cyan=266 and Black=260. These values do vary as a better understanding of the toner formulations and concentrations are assessed. However, they remain in the 250 to 270 Electronegativity range.

Wire Contamination:

Wire Contamination is a failure mode where toner and toner additives mechanically attach to the bottom of the electrode wire (area at the wire to donor roller interface). The result is an insulating barrier that depresses or suppresses the toner cloud and development. While initially the contamination occurs at the bottom surface of the electrode over time the contamination works its way around to the top of the wire where it, as mentioned above, can cause other undesired phenomena in addition to underdevelopment. This failure mode is present in polymer-coated wires or stainless steel wires with a roughened surface. The contamination is primarily made of toner additives such as silica and titanium, which become imbedded in the polymer coating or packed into the rough spots of metal wires. Once the contamination has an initiation site it grows into a uniform barrier also packing in toner. On rough stainless steel, the contamination can be easily mechanically removed. The polymer-coated wires generate contamination that adheres very well and is only removed with aggressive means that lead to the removal of the polymer coating and the reintroduction of wire history as a failure mode.

Testing has shown that to combat wire contamination the wire surface must have hardness comparable to that of the 304 stainless wire and have a smooth surface finish. To that end, it is noted that Ion Implantation does not significantly alter the surface finish. It does however increase the hardness, which is beneficial.

The use of Ion Implantation to tribo-electrically tune metals to toners can be applied to any electrode/donor roll development system to preclude or at least minimize electrostatic attraction between the toner and the electrode. In the case of HSD wires, its effect on the reduction of wire history to manageable levels while maintaining the ability to counteract wire contamination illustrate the usefulness of Ion Implantation to simultaneously overcome the problems of wire history and wire contamination.

What is claimed is:

1. Apparatus for developing latent electrostatic images on a charge retentive surface, said apparatus comprising:

a supply of toner;

a toner donor member spaced from said charge retentive surface for transporting toner to a development zone intermediate said charge retentive surface and said toner donor member;

a plurality of wire electrode members positioned in said development zone, said wire electrode members being closely spaced to said donor member and being electrically biased for establishing an electrostatic field for effecting detachment of toner from said donor member thereby effecting a toner cloud in said development zone with detached toner from said toner cloud being attracted to said latent images whereby toner particles are attracted to latent electrostatic images formed in said charge retentive surface;

means forming a part of each of said electrode members for minimizing the phenomena of wire history without diminishing the hardness of said electrode member.

2. The apparatus according to claim 1 wherein each of said wires is coated with a material impregnated with ions for producing the desired Electronegativity exhibited by each of said wires.

3. The apparatus according to claim 2 including a metallic coating on said wire electrode members, said coating also being impregnated with ions that in combination with said ions impregnated in said wire electrode structures produce the desired Electronegativity value in said wire electrode members.

4. The apparatus according to claim 3 wherein said metallic coating comprises an alloy of gold and platinum.

5. The apparatus according to claim 4 wherein the percentage of gold in said alloy is approximately 90%.

6. The apparatus according to claim 5 wherein said ions comprise fluorine.

7. An electrode structure for use in Hybrid Scavengless Development of latent electrostatic images with toner, said structure comprising:

means forming a part of said electrode member for minimizing the phenomena of wire history without diminishing the hardness of said electrode member when said toner interacts with said electrode member.

8. The structure according to claim 7 wherein said wire is coated with a material impregnated with ions for producing the desired Electronegativity exhibited by said wire.

9. The structure according to claim 8 including a metallic coating on said on said wire electrode structure, said coating also being impregnated with ions that in combination with the ions impregnated in said wire electrode structure produce the desired Electronegativity value in said wire electrode members.

10. The structure according to claim 7 wherein said metallic coating comprises an alloy of gold and platinum.

11. The structure according to claim 10 wherein the percentage of gold in said alloy is approximately 90%.

12. The structure according to claim 11 wherein said ions comprise fluorine.

* * * * *